US008025006B2

(12) United States Patent
Baros

(10) Patent No.: US 8,025,006 B2
(45) Date of Patent: Sep. 27, 2011

(54) MEANS FOR PROVIDING UP-RELIEF TO A HYDRAULIC CYLINDER UNIT

(75) Inventor: Davor Baros, Vancouver (CA)

(73) Assignee: Teleflex Canada Inc., Richmond (CA)

( * ) Notice: Subject to any disclaimer, the term of this patent is extended or adjusted under 35 U.S.C. 154(b) by 789 days.

(21) Appl. No.: 11/952,086

(22) Filed: Dec. 6, 2007

(65) Prior Publication Data

US 2009/0149091 A1 Jun. 11, 2009

(51) Int. Cl.
*B30B 1/32* (2006.01)
*F16F 11/00* (2006.01)

(52) U.S. Cl. ..... 91/400; 92/163; 440/56

(58) Field of Classification Search ..... 91/400, 91/402; 92/163; 440/53, 56, 61 T
See application file for complete search history.

(56) References Cited

U.S. PATENT DOCUMENTS 4,419,083 A * 12/1983 Taguchi ..... 440/61 T
4,545,770 A 10/1985 Ferguson
4,720,278 A 1/1988 Taguchi et al.
4,764,134 A 8/1988 Watanabe
4,784,625 A * 11/1988 Nakahama ..... 440/56
5,032,094 A 7/1991 Katogi
5,389,018 A * 2/1995 Funami ..... 440/61 R
5,597,333 A 1/1997 Soda
6,044,752 A * 4/2000 Harigaya ..... 92/163
6,071,157 A 6/2000 Yoshino et al.
6,558,212 B2 * 5/2003 Saito ..... 440/56
6,824,435 B2 11/2004 Divisi
6,837,761 B2 1/2005 Saito
7,407,420 B2 * 8/2008 Fetchko et al. ..... 440/61 T

* cited by examiner

*Primary Examiner* — Thomas E Lazo
(74) *Attorney, Agent, or Firm* — Cameron IP

(57) ABSTRACT

A hydraulic cylinder unit comprises a cylinder, a piston disposed within the cylinder, and piston rod connected to the piston. The piston rod is reciprocatingly received within the cylinder, and the piston rod being movable between a first position in which the piston rod is substantially disposed within the cylinder and a second position in which the piston rod is fully extended outside the cylinder. A first hydraulic port and a second hydraulic port hydraulically connecting the cylinder unit to a reservoir. Hydraulic fluid is received by the first hydraulic port and hydraulic fluid is discharged by the second port when the piston rod is actuated to move towards the first position. Hydraulic fluid is received by the second hydraulic port and hydraulic fluid is discharged by the first hydraulic port when the piston rod is actuated to move towards the second position. A bore connects the tilt cylinder to a down gallery allowing hydraulic fluid within the cylinder to re-circulate to the reservoir when the piston rod is fully extended outside the cylinder.

5 Claims, 13 Drawing Sheets

MEANS FOR PROVIDING UP-RELIEF TO A HYDRAULIC CYLINDER UNIT

BACKGROUND OF THE INVENTION

1. Field of the Invention

The present invention relates to a means for providing up-relief to a hydraulic cylinder unit and, in particular, to a means for providing up-relief to a trim cylinder unit which forms part of a trim and tilt cylinder apparatus.

2. Description of Related Art

Conventional trim and tilt systems include a unitary trim and tilt cylinder apparatus, as disclosed in U.S. Pat. No. 5,032,094, issued Jul. 16, 1991 to Sadaji Katogi, hereinafter Katogi. Katogi discloses a trim and tilt system for trimming and tilting an outboard propulsion unit on a boat. The trim and tilt system disclosed by Katogi includes a unitary trim and tilt cylinder apparatus having a tilt cylinder unit and a pair of trim cylinder units, a stern bracket adapted to be mounted on the transom of the boat, a swivel bracket for supporting the outboard propulsion unit, the swivel bracket being pivotally supported on an upper end of the stern bracket, and a hydraulic pressure circuit for actuating the tilt cylinder unit and the trim cylinder units. The trim and tilt cylinder apparatus has an upper end pivotally supported on the stern bracket and a lower end pivotally supported on the swivel bracket.

The trim and tilt system disclosed by Katogi has the disadvantage of undue stress being applied to the trim cylinder units at a point of contact of a trim rod of each of the trim cylinder units with the swivel bracket. This excessive stress is in part due to the unitary construction of the trim and tilt cylinder apparatus. As the outboard propulsion unit pivots during the trimming and tilting procedure, the angle of the trim rods of each of the trim cylinder units changes with respect to the swivel bracket. The weight of the propulsion unit is therefore applied to the trimming procedure. As a result, a considerable amount of transverse stress is applied between the trim rods and their respective trim cylinders, leading to undue wear and fatigue.

The trim and tilt system disclosed by Katogi also has the disadvantage of generating high pressures and excessive motor current draw during the trimming and tilting procedure. This generation of high hydraulic pressures and excessive motor draw is in part due to the construction of the trim cylinder units. Hydraulic fluid is pumped into the bottoms of the trim cylinders when the outboard propulsion unit is moved from a lower position to an upper position. This causes the trim rods to extend outside the trim cylinders and engage the swivel bracket, thereby pivoting the swivel bracket and outboard propulsion unit upwardly. However, if hydraulic fluid continues to be pumped into the bottoms of the trim cylinders while the trim rods are fully extended outside the trim cylinders, this will result in the generation of high pressures and excessive motor draw. The trim cylinder units disclosed by Katogi do not have a means for providing up-relief.

There is therefore a need for a new and improved trim and tilt system that reduces the stress and pressure experienced by trim cylinder units during the trimming and tilting of a marine propulsion unit.

SUMMARY OF THE INVENTION

There is provided a hydraulic cylinder unit comprising a cylinder, a piston disposed within the cylinder, and a piston rod connected to the piston. The piston rod is reciprocatingly received within the cylinder, and the piston rod is movable between a first position in which the piston rod is substantially disposed within the cylinder, and a second position in which the piston rod is fully extended outside the cylinder. A first hydraulic port and a second hydraulic port hydraulically connecting the cylinder unit to a reservoir. Hydraulic fluid is received by the first hydraulic port and hydraulic fluid is discharged by the second port when the piston rod is actuated to move towards the first position. Hydraulic fluid is received by the second hydraulic port and hydraulic fluid is discharged by the first hydraulic port when the piston rod is actuated to move towards the second position. A bore connects the cylinder to a down gallery allowing hydraulic fluid within the cylinder to re-circulate to the reservoir when the piston rod is fully extended outside the cylinder.

The hydraulic cylinder unit may be either a tilt cylinder unit which forms part of a trim and tilt system or the hydraulic cylinder unit may be a trim cylinder unit which forms part of a trim and tilt apparatus.

DETAILED DESCRIPTION OF THE PREFERRED EMBODIMENTS

Figure 1:
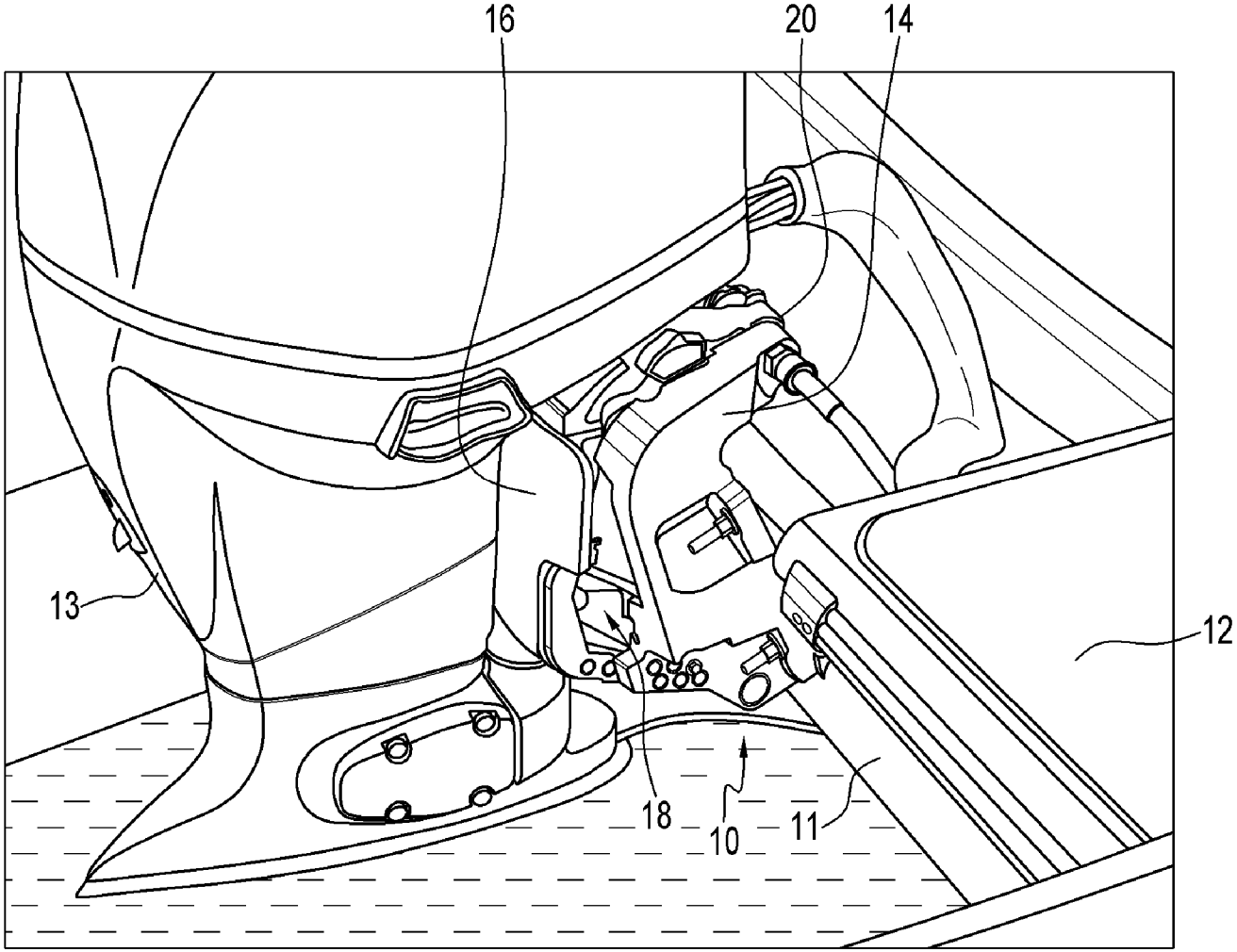
FIG. 1 is a perspective view of a trim and tilt system in operative arrangement between a marine craft and a motor.

Referring to the drawings and first to FIG. 1, there is shown a trim and tilt system, indicated generally by reference numeral 10, for trimming and tilting an outboard propulsion unit 13. The trim and tilt system 10 is operatively mounted on a transom 11 of a marine craft 12 and operates to position the outboard propulsion unit 13 between a lower position and an upper position. The trim and tilt system 10 includes a stern bracket 14, a swivel bracket 16, and a trim and tilt cylinder apparatus which is indicated generally by reference numeral 18.

Figure 14:
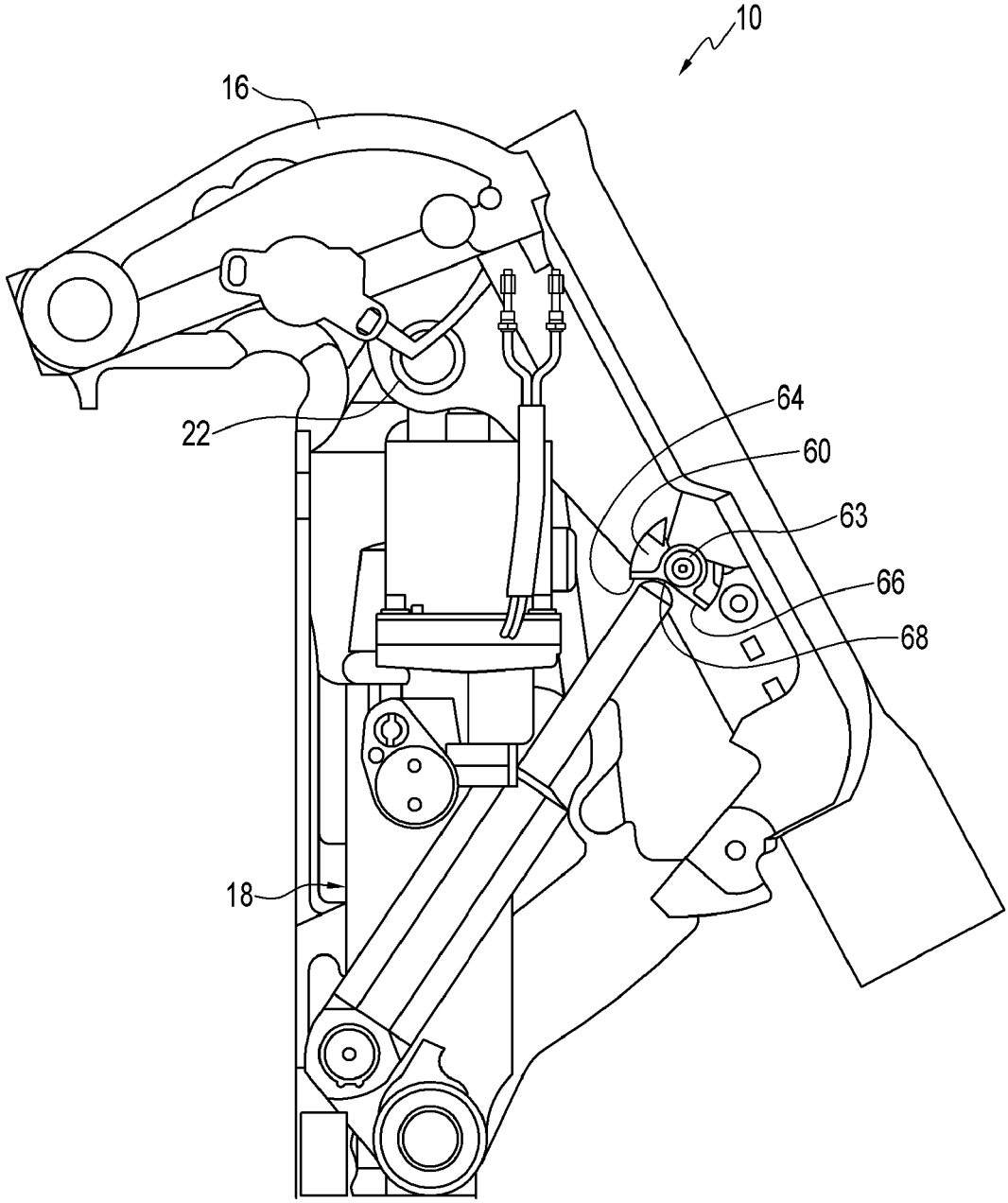
FIG. 14 is a side sectional view of the trim and tilt system of FIG. 1 shown in a mid-position.
Figure 15:
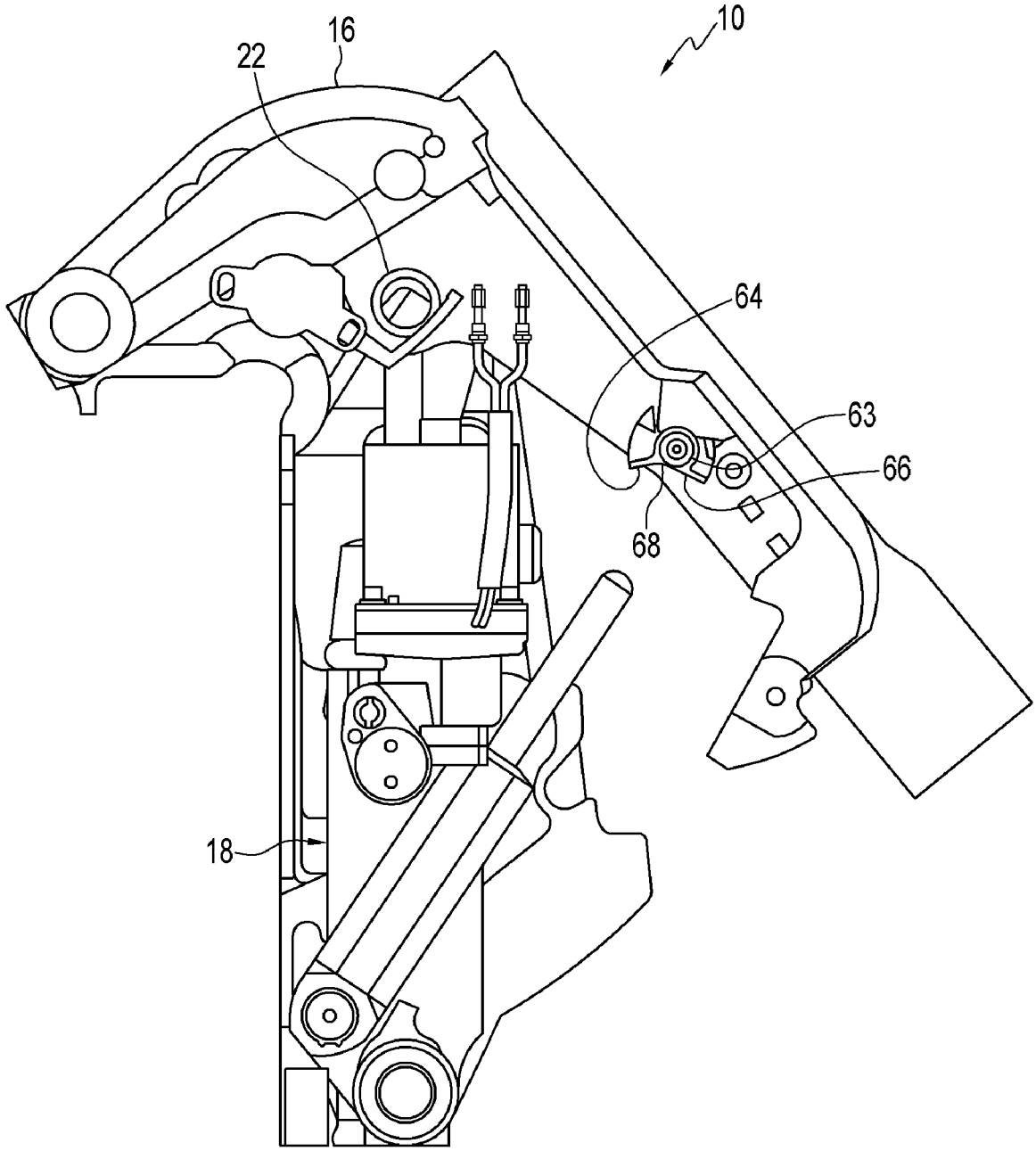
FIG. 15 is a side sectional view of the trim and tilt system of FIG. 1 in show in an upper position.

The stern bracket 14 is mounted on the transom 11 of the marine craft 12. The swivel bracket 16 supports the outboard propulsion unit 13, and is pivotally connected with the marine craft 12 at a pivotal connection 20 which is located at an upper end of the stern bracket 14. The trim and tilt cylinder apparatus 18 has a lower end supported by the stern bracket 14 and is pivotally connected at an upper end with the swivel bracket 14 at a pivotal connection 22, which is best shown in FIGS. 14 and 15.

Referring now to FIGS. 2 to 5, in which the trim and tilt cylinder apparatus 18 is shown in greater detail, the trim and tilt cylinder apparatus 18 comprises a tilt cylinder unit 24 and at least one trim cylinder unit. In this example there are two trim cylinder units 26 and 26.1. The trim and tilt cylinder apparatus 18 also includes a pumping unit 50 and a reservoir 52 for providing hydraulic fluid to the tilt cylinder unit 24 and each of the trim cylinder units 26 and 26.1. The pumping unit 50, the reservoir 52, the tilt cylinder unit 24, and the trim cylinder units 26 and 26.1 form a hydraulic circuit. Hydraulic fluid is pumped, or discharged, into and out of the tilt cylinder unit 24 and the trim cylinder units 26 and 26.1 during operation of the trim and tilt apparatus 18 in order to move the outboard propulsion unit 13 between the lower position and the upper position.

The tilt cylinder unit 24 has a tilt cylinder 28, a tilt rod 30, and a piston (not shown). The piston is disposed within the tilt cylinder 28 and connected to the tilt rod 30. The tilt rod 30 reciprocatingly extends from a top 32 of the tilt cylinder 28. There is a clevis 34, in the form of an annular ring in this example, at a distal end of the tilt rod 30. The clevis 34 pivotally connects to the propulsion unit 13, e.g. the motor, of the marine craft 12 which is shown in FIG. 1.

The trim cylinder units 26 and 26.1 are on opposite sides of the tilt cylinder unit 24 and are substantially the same with a first one of the trim cylinder units 26 being a mirror-image of a second one of the trim cylinder units 26.1. Accordingly, only the first trim cylinder unit 26 is described in detail herein with the understanding that second trim cylinder unit 26.1 has a similar structure and function. For the second trim cylinder unit 26.1 like parts have been given like reference numerals as the first trim cylinder unit 26 with the additional numerical designation ".1". Each of the trim cylinder units 26 and 26.1 has a pivotal connection 42 and 42.1. In this example, each of the pivotal connections 42 and 42.1 of the trim cylinder units 26 and 26.1 are pivotally independent of each other. This allows the trim cylinder units 26 and 26.1 to move independently of each other. However, this is not a requirement. Trim rods 38 and 38.1 reciprocatingly extend out of the tops of respective ones of the trim cylinders 36 and 36.1 ends opposite to the pivotal connections 42 and 42.1, respectively.

Figure 6:
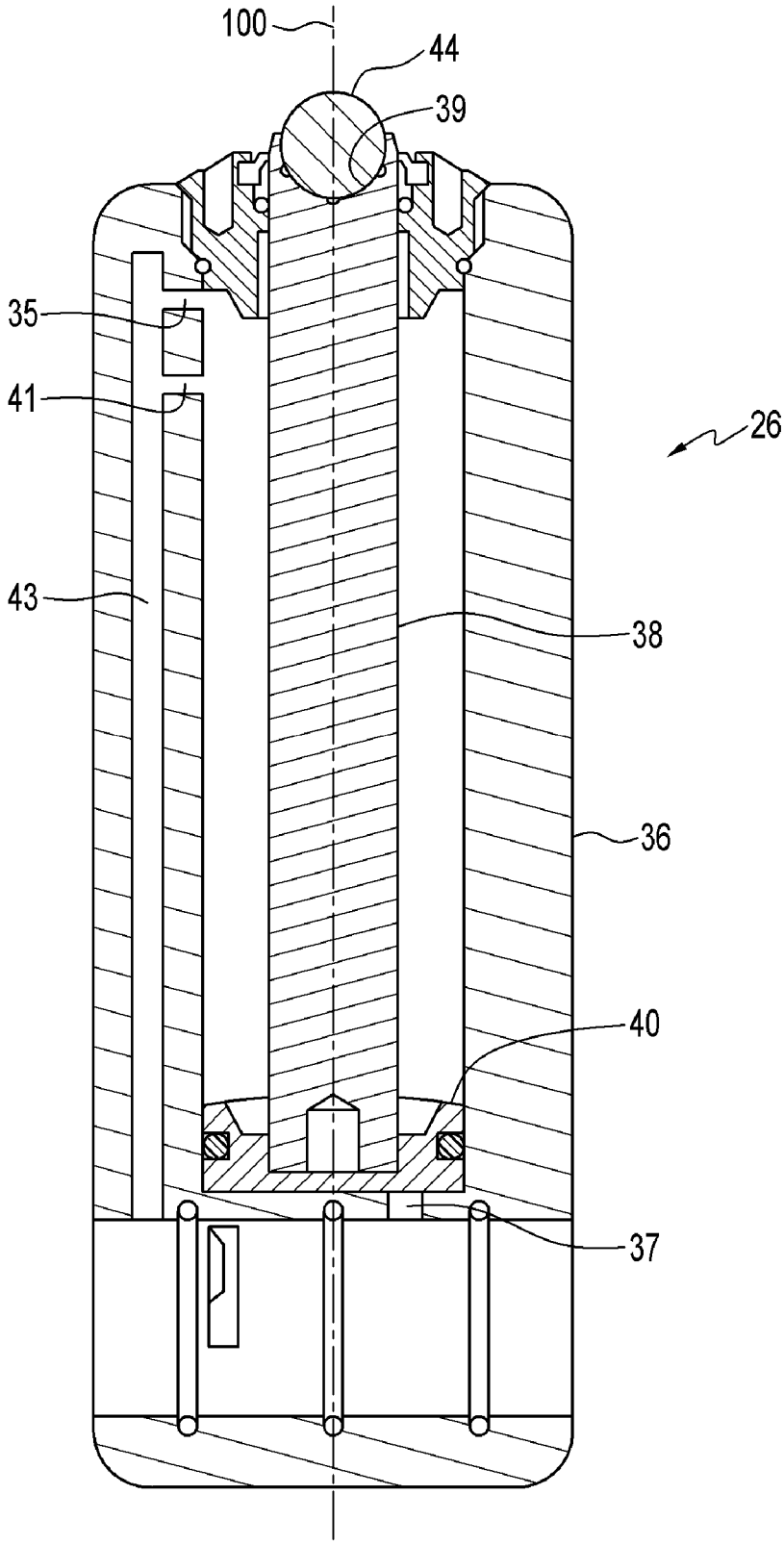
FIG. 6 is a side sectional view of a trim cylinder unit of the trim and tilt cylinder apparatus of FIG. 2 showing the trim rod disposed within the trim cylinder.
Figure 7:
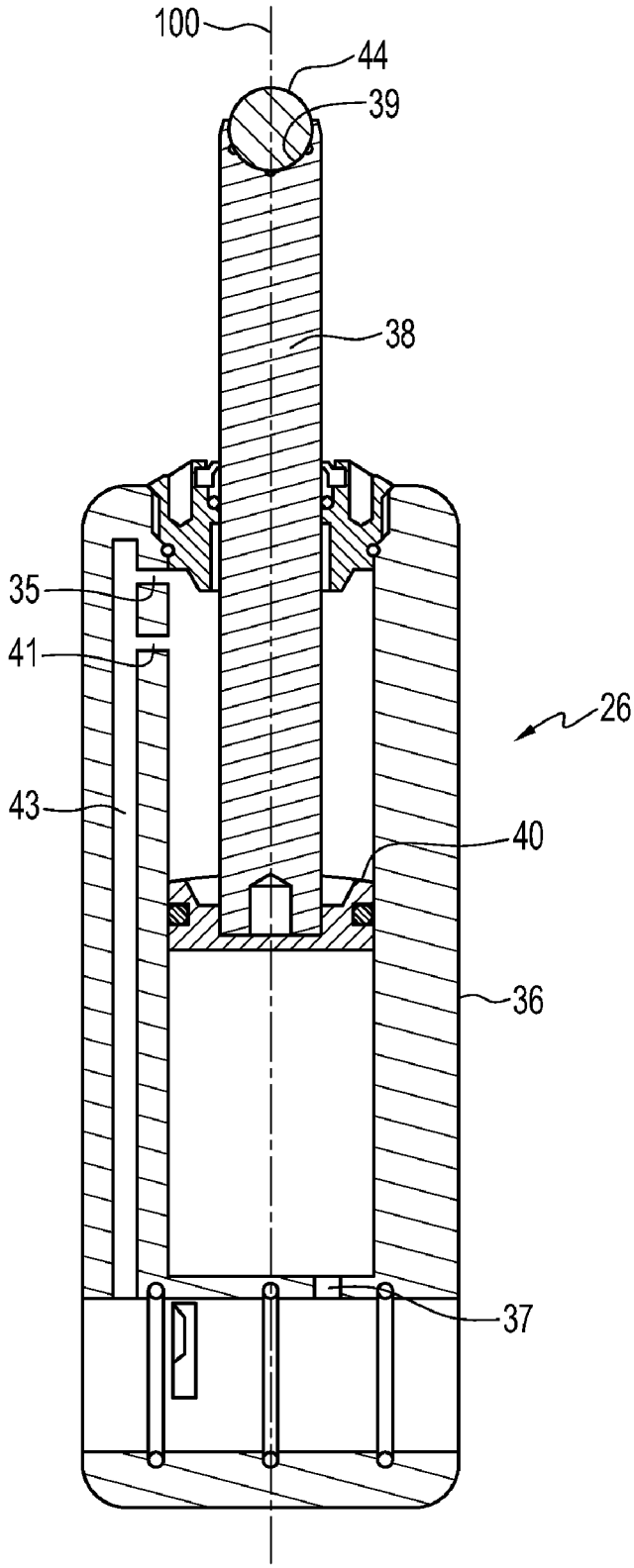
FIG. 7 is a side sectional view of the trim cylinder unit of FIG. 6 showing the trim rod partially extended outside the trim cylinder.
Figure 8:
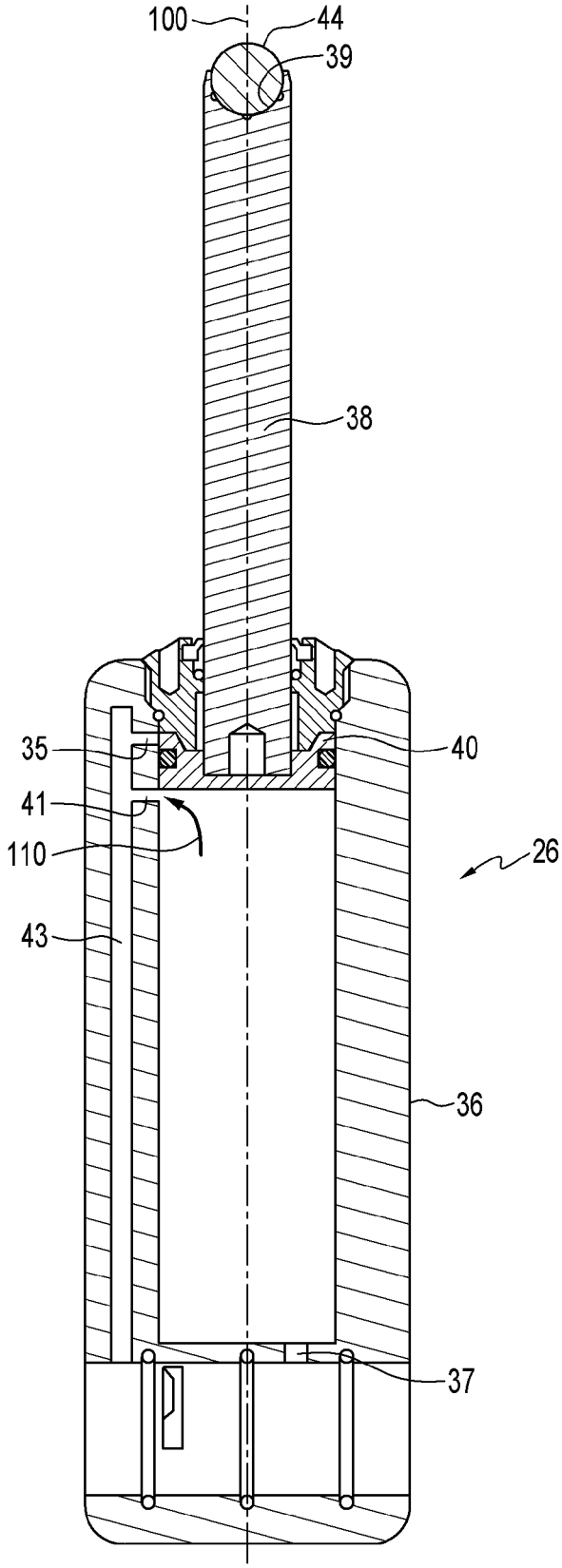
FIG. 8 is a side sectional view of a trim cylinder unit of FIG. 6 showing the trim rod fully extended outside the trim cylinder.

As best shown in FIGS. 6 to 8, the first trim cylinder unit 26 has a trim cylinder 36, a trim rod 38, and a piston 40. In this example, the trim rod 38 has a bore 39 at an distal end thereof The bore 39 has a ball bearing 44 pressed therein. The piston 40 is connected to the trim rod 38 and both are movable along a longitudinal axis 100 of the trim cylinder 36. The piston 40 and trim rod 38 are movable between a first position, shown in FIG. 6, in which the trim rod 38 is substantially disposed within the trim cylinder 36 and a second position, shown in FIG. 8, in which the trim rod 38 is fully extended outside the trim cylinder 36. FIG. 7 shows the trim rod 38 in an intermediate position.

Figure 2:
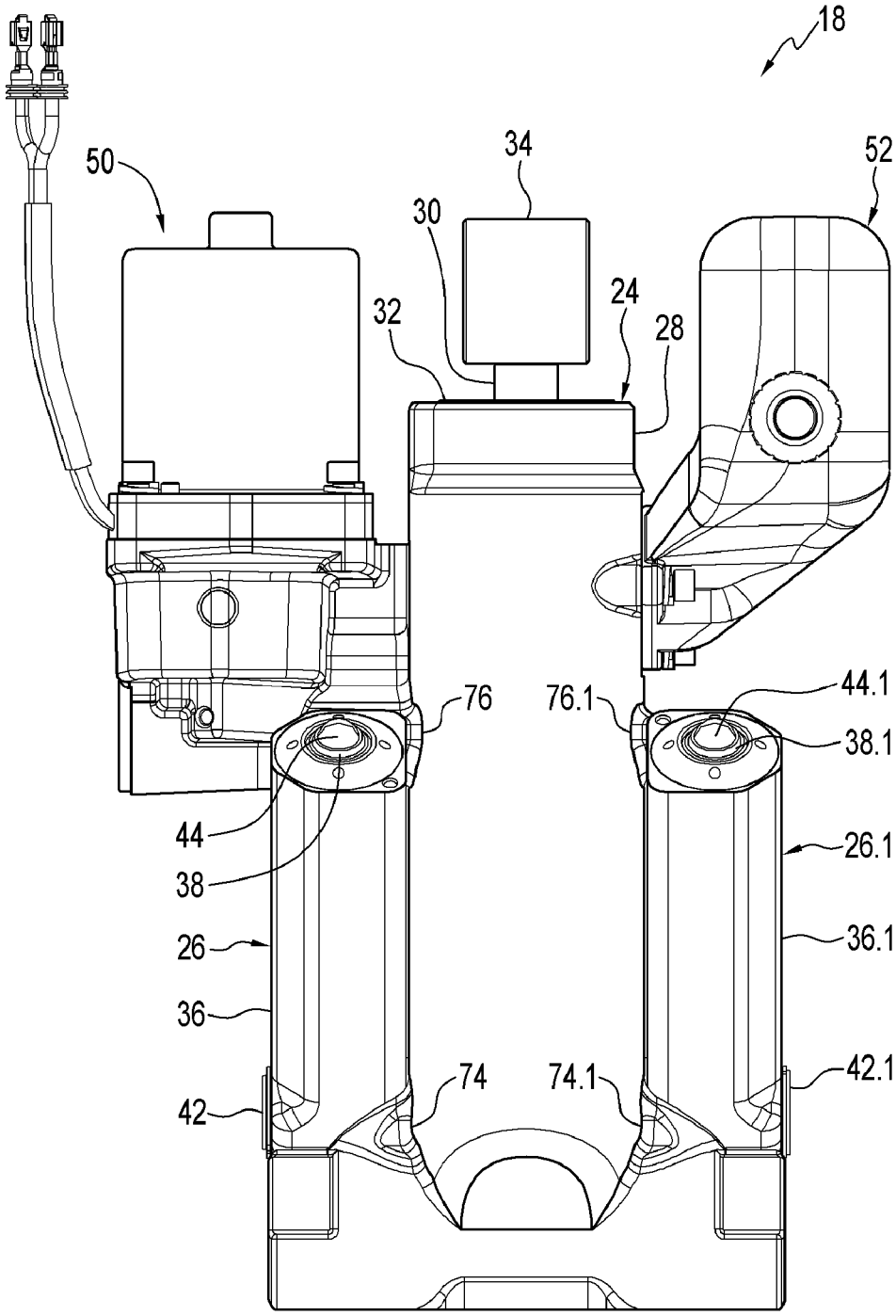
FIG. 2 is a front elevational view of a trim and tilt cylinder apparatus of the trim and tilt system of FIG. 1.
Figure 3:
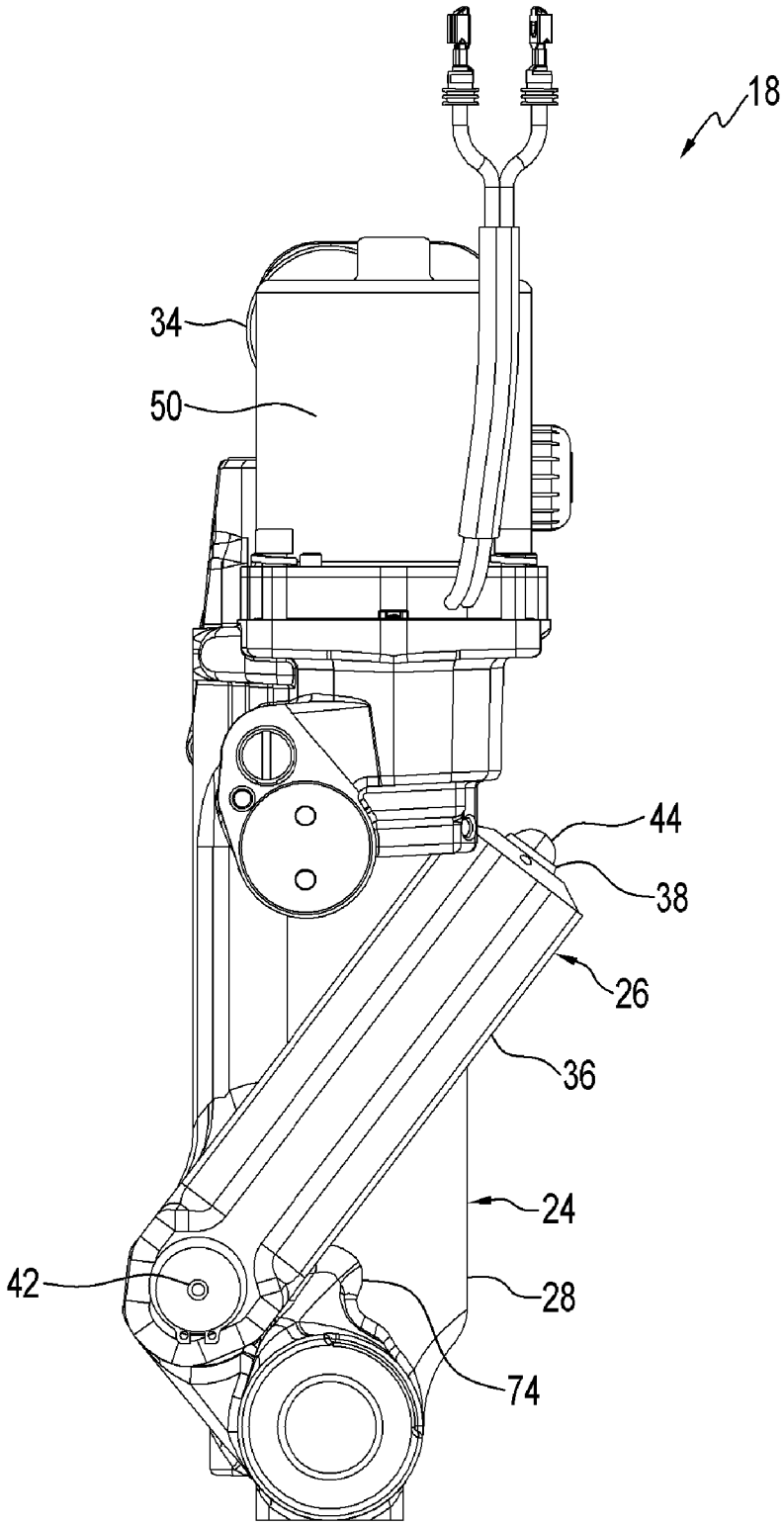
FIG. 3 is a side elevational view of a first side of the trim and tilt cylinder apparatus of FIG. 2.
Figure 4:
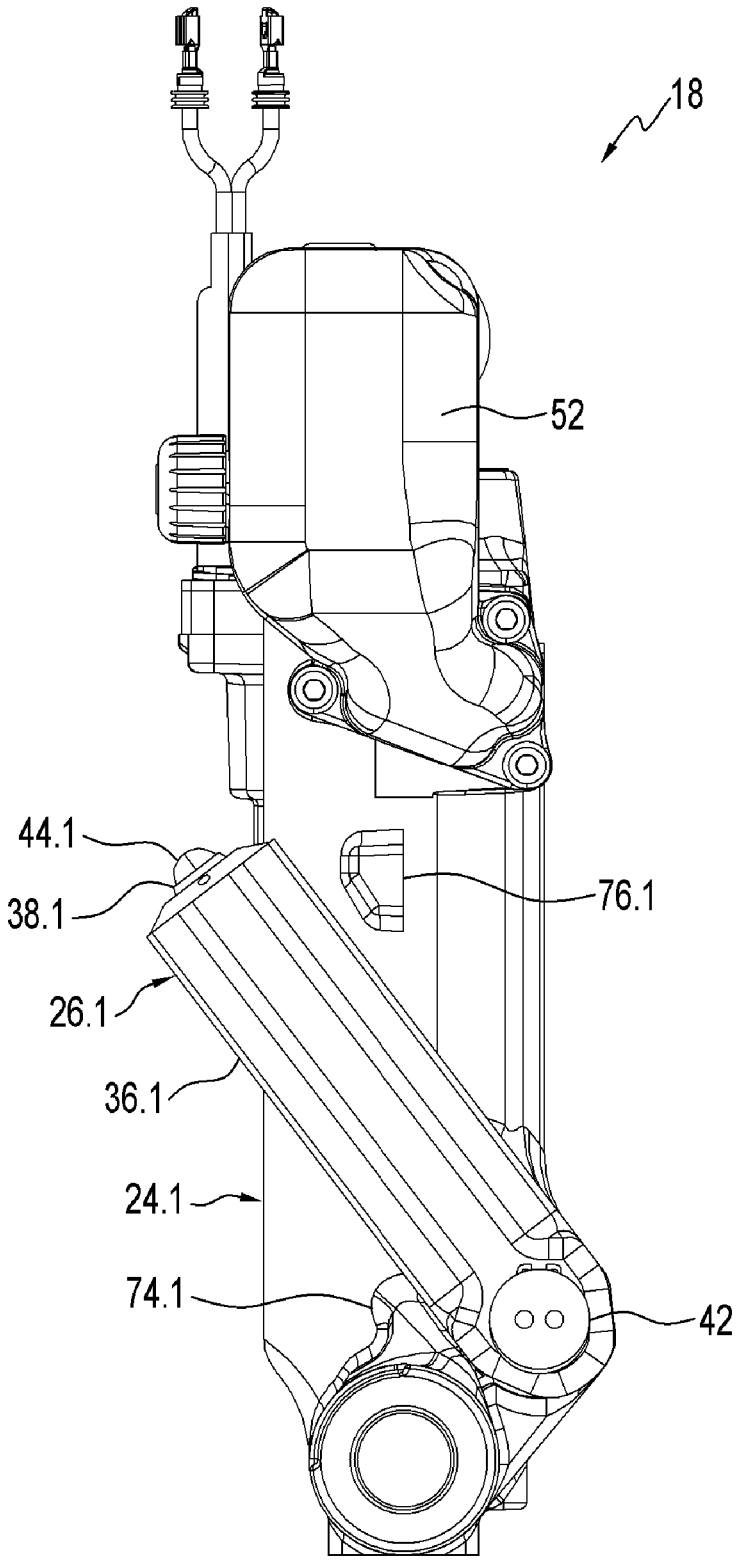
FIG. 4 is a side elevational view of a second side of the trim and tilt cylinder apparatus of FIG. 2.
Figure 5:
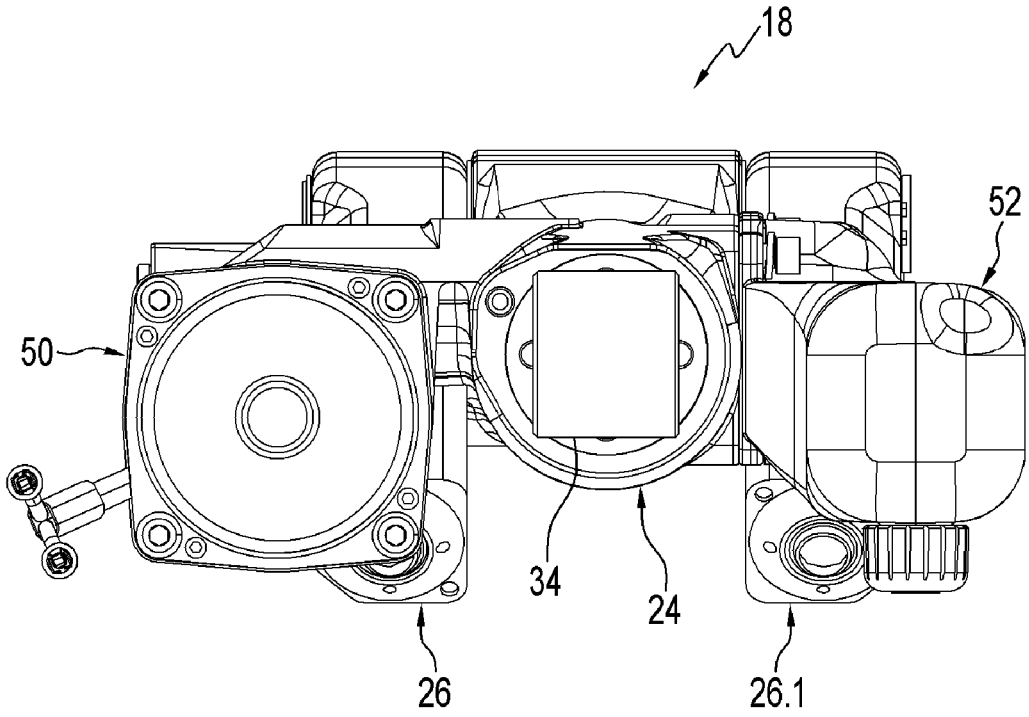
FIG. 5 is a top planar view of the trim and tilt cylinder apparatus of FIG. 2.

A first hydraulic port 35 and second hydraulic port 37 hydraulically connect the trim cylinder unit 26 to the pumping unit 50 and the reservoir 52 which are shown in FIG. 2. The hydraulic ports 35 and 37 are located at opposite ends of the trim cylinder unit 26. Hydraulic fluid is received by the first hydraulic port 35 and discharged out of the second hydraulic port 37 when the trim rod 38 is actuated to move towards the first position. Hydraulic fluid is received by the second hydraulic port 37 and discharged out of the first hydraulic port 35 when the trim rod 38 is actuated to move towards the second position. The trim cylinder 36 is further provided with a bore 41 near the first hydraulic port 35 which connects an interior of the trim cylinder 36 to a down gallery 43. The down gallery leads to the reservoir 52.

The bore 41 permits up-relief by allowing fluid from within the trim cylinder to re-circulate to the reservoir 52 when the trim rod 38 is fully extended outside the trim cylinder 36. This is shown generally by arrow 110 in FIG. 8. The re-circulation of hydraulic fluid inhibits the generation of high pressures and excessive motor current draw. It will be understood by a person skilled in the art that a similar bore may be provided, as a means for providing up-relief, on any hydraulic cylinder unit which generally comprises a cylinder, a piston, a piston rod, along with first and second hydraulic port. For example, a similar bore may be provided on the tilt cylinder unit described herein.

Figure 9:
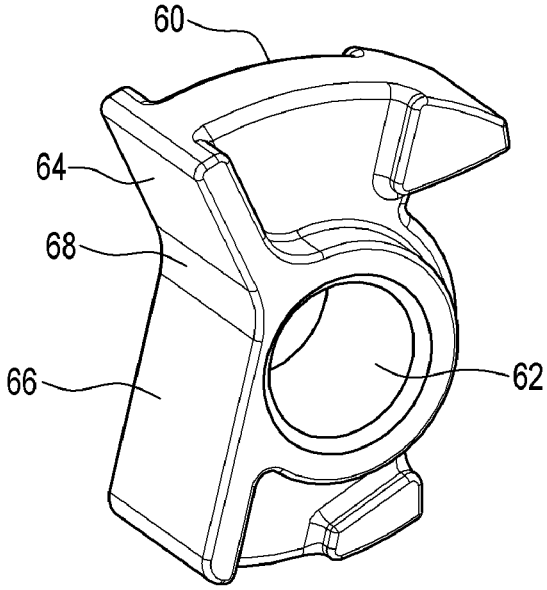
FIG. 9 is a perspective view of a trim receiver of the trim and tilt cylinder system of FIG. 1.
Figure 10:
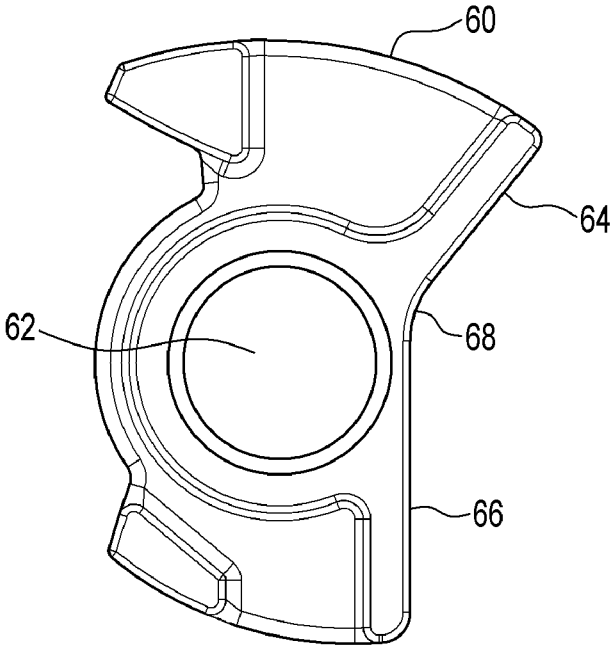
FIG. 10 is a side elevational view of the trim receiver of FIG. 9.
Figure 13:
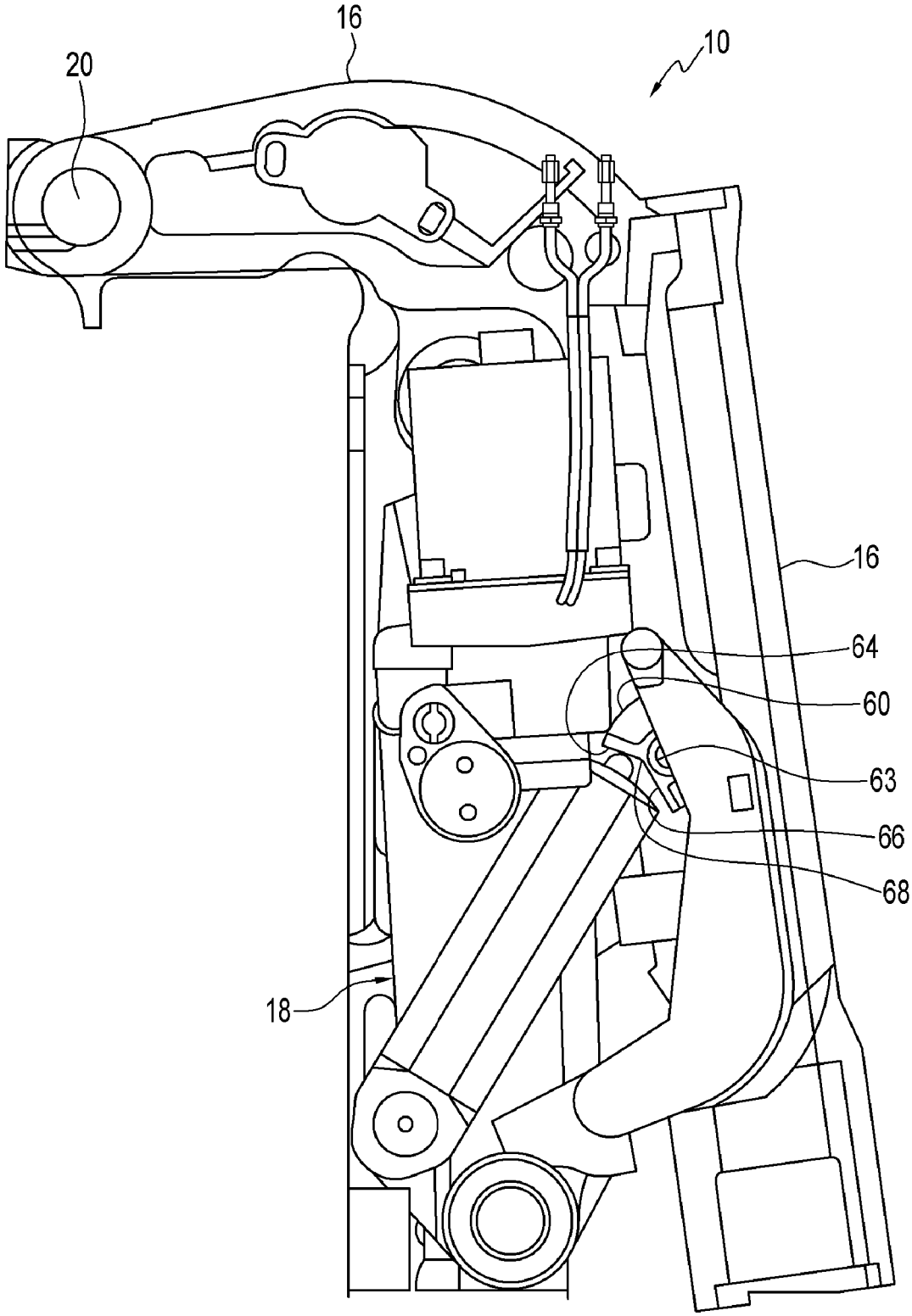
FIG. 13 is a side sectional view of the trim and tilt system of FIG. 1 shown in a lower position.

The trim and tilt apparatus 18 further includes a pair of trim receivers, each configured with a respective one of the trim cylinder units 26 and 26.1. As best shown in FIGS. 9 and 10, each trim receiver 60 has a concave surface. Each trim receiver 60 also has a bore 62 and is connected with the swivel bracket 14 at a respective pivotal connection 63 as shown in FIGS. 13 to 15. The pivotal connection 63 allows for pivotation of respective ones of the trim receivers allowing for engagement with respective ones of the trim rods 38 and 38.1, as will be explained in more detail below.

Figure 11:
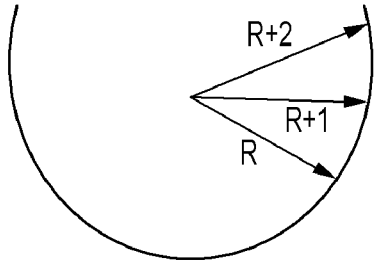
FIG. 11 is graphical representation of a spherical cone where the radius r varies according to the equation $r=R+x$, where R is the minimum radius and x is a positive integer.
Figure 12:
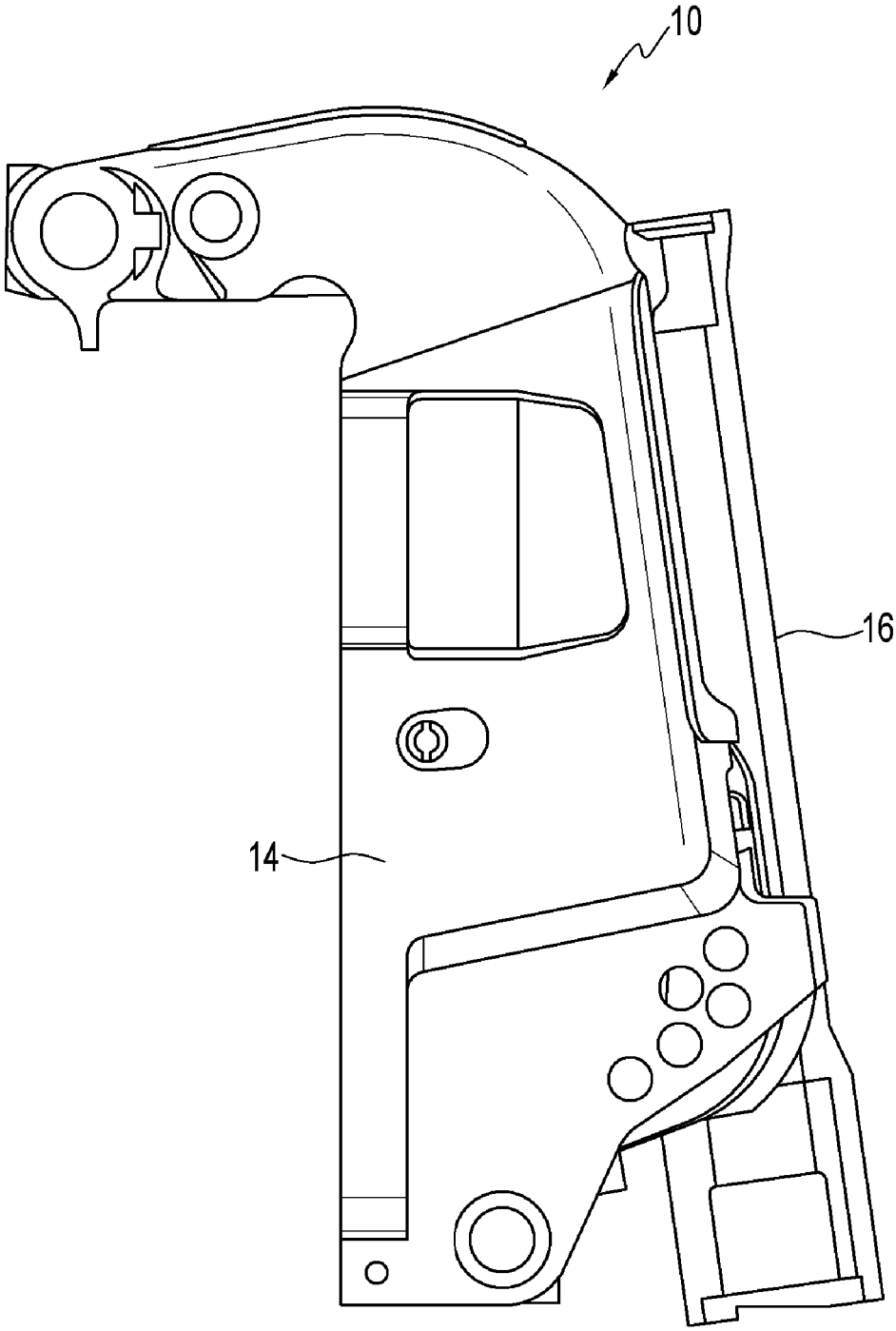
FIG. 12 is a side elevational view of the trim and tilt system of FIG. 1.

Referring back to FIGS. 9 and 10, in this example, each trim receiver 60 has a first surface 64, a second surface 66 and a receptacle 68 therebetween. The first and second surfaces 64 and 66 are arranged at an inclination with respect to each other with the receptacle 68 forming a vertex of the concave surface. As shown in FIGS. 13 to 15, for the first trim cylinder unit 26, each of the trim receivers is in operative correspondence with a respective one of the trim rods of the trim cylinder units. In an another embodiment, the trim receivers may form the shape of a spherical cone as illustrated in FIG. 11, where the radius r varies according to the equation $r=R+x$, where R is a minimum radius and x=1, 2, 3, 4, etc. Alternatively, in yet another embodiment the trim receiver may be in the form of a three-dimensional concave or parabolic receptacle for receiving respective ones of the trim rods.

As best shown in FIG. 2, in this example, the trim and tilt cylinder apparatus 18 further includes a pair of pads 74 and 76, for the first trim cylinder unit 26, and 74.1 and 76.1, for the second trim cylinder unit 26.1. The pads 74, 76, 74.1 and 76.1 are aluminum pads in this example, but can be resilient pads in other embodiments, e.g. non-linear springs, non-linear rubber bumpers or polyurethane pads. The pads may also be inserts which can be installed and removed. The pads 74, 76, 74.1 and 76.1 act to limit the pivotation of the trim cylinder units 26 and 26.1 about respective ones of the pivotal connections 42 and 42.1. The trim rods 38 and 38.1 are held in operative engagement with the trim receivers by this limited pivotation of the pivotal connections 42 and 42.1, as will be explained in more detail below.

In operation, when the propulsion unit 13 of the marine craft 12 is to be moved from the lower position to the upper position, the pumping unit 50 actuates the tilt cylinder unit 24 and the trim cylinder units 26 and 26.1 from the position shown in FIG. 13. The tilt rod 30 extends from the tilt cylinder 28 causing the swivel bracket 16 to pivot upwardly about connection 20. As shown for the first trim cylinder unit 26, the trim rods 38 extend from respective ones of the trim cylinders 36 causing the ball bearings 44 on the trim rods 38 to come into operative engagement with respective ones of the trim receivers 60 on the swivel bracket 16 thereby pivoting the swivel bracket 16 upwardly at connection 20. This phase of the operation is considered the trimming phase.

The trimming phase ends when the trim rods 38 are fully extended out of the trim cylinders 36, as shown in FIG. 14, for the first trim cylinder unit 26. After the trim rods 38 have extended fully out of the trim cylinders 36, the tilt rod 30 continues to pivot the swivel bracket 16, and the trim receivers 60 move away from the ball bearings 44 of the trim rods 38, as shown in FIG. 15, again for the first trim cylinder unit 26. This phase of the operation is considered the tilting phase of the operation. The swivel bracket 16 continues to pivot at connection 20 until the tilt rod 30 is fully extended out of the tilt cylinder 28.

Considering now the opposite motion, when the trim and tilt apparatus 10 moves the outboard propulsion unit 13 from the upper position to the lower position. The pumping unit 50 actuates the tilt cylinder unit 24 to retract the tilt rod 30 into the tilt cylinder 28, thereby causing the swivel bracket 16 to pivot downwardly about the connection 20. Eventually the trim receivers 60 on the swivel bracket 16 come into contact with respective ones of the ball bearings 44 on each of the trim rods 38.

In this example, the ball bearings 44 come into contact with one of either the first surface 64 or the second surface 66 of respective ones of the trim receivers 60, which then guide the trim rods 38 towards the receptacles 68. Normally, the ball bearings 44 of the trim rods 38 initially contact the first surface 64 of respective ones of the trim receivers 60. The trim receivers 60 then pivot so that the force exerted by the trim receivers 60 on the trim rods 38 is along the longitudinal axis 100 of the trim cylinder units 26.

The pumping unit 50 continues to actuate the tilt cylinder unit 24, and also the trim cylinder units 26 so that the trim rods 38 retract into respective ones of the trim cylinders 36, until both the tilt rod 30 and the trim rods 38 are fully retracted in the respective tilt cylinder 28 and trim cylinders 36, as shown in FIG. 13.

The trim receivers 60 of the present invention provide the advantage of allowing the trim rods 38 to self align within the trim receivers 60, such that as the outboard propulsion unit 13 is moved between lower and upper positions, the force exerted by the propulsion unit 13 through the trim receivers 60 on the trim rods 38 is substantially along the longitudinal axis 100 of the trim cylinders 36 and the trim rods 38. This minimizes the stress put on the trim cylinder units 26 as the outboard propulsion unit 13 is moved between the lower and the upper positions, and also allows the trim cylinder units 26 to handle a greater load.

Another advantage of the present invention is achieved by the pads 74, which limit the pivotal range of the pivotal connections 42. The predetermined range of the pivotal connections 42 ensures that the trim rods 38 will always come into operative engagement with respective ones of either the first surface 64 of the trim receiver 60, the second surface 66 of the trim receiver 60 or directly with the receptacle 68 of the trim receiver 60.

It will be understood by someone skilled in the art that in another embodiment a pivotable trim receiver may be threadedly received in an aperture of the trim rod to allow for engagement of the trim cylinder unit and a projection on the swivel bracket.

It will be further understood by someone skilled in the art that many of the details provided above are by way of example only and are not intended to limit the scope of the invention which is to be determined with reference to the following claims.

What is claimed is:

1. A hydraulic cylinder unit comprising:

a cylinder;

a piston disposed within the cylinder;

a piston rod connected to the piston, the piston rod being reciprocatingly received within the cylinder, and the piston rod being movable between a first position in which the piston rod is substantially disposed within the cylinder and a second position in which the piston rod is fully extended outside the cylinder;

a first hydraulic port and a second hydraulic port hydraulically connecting the cylinder unit to a reservoir, hydraulic fluid being received by the first hydraulic port and hydraulic fluid being discharged by the second hydraulic port when the piston rod is actuated to move towards the first position, and hydraulic fluid being received by the second hydraulic port and hydraulic fluid being discharged by the first hydraulic port when the piston rod is actuated to move towards the second position; and a bore connecting the cylinder to a down gallery, the bore allowing hydraulic fluid within the cylinder to recirculate to the reservoir when the piston rod is fully extended outside the cylinder.

2. The hydraulic cylinder unit as claimed in claim 1 wherein the hydraulic cylinder unit is a tilt cylinder unit which forms part of a trim and tilt apparatus.

3. The hydraulic cylinder unit as claimed in claim 1 wherein the hydraulic cylinder unit is a trim cylinder unit which forms part of a trim and tilt apparatus.

4. A trim cylinder unit which forms part of a trim and tilt system, the trim cylinder unit comprising:

a trim cylinder;

a piston disposed within the trim cylinder;

a trim rod connected to the piston, the trim rod being reciprocatingly received within the trim cylinder, and the trim rod being movable between a first position in which the trim rod is substantially disposed within the trim cylinder and a second position in which the trim rod is fully extended outside the trim cylinder;

a first hydraulic port and a second hydraulic port hydraulically connecting the trim cylinder unit to a reservoir, hydraulic fluid being received by the first hydraulic port and hydraulic fluid being discharged by the second hydraulic port when the trim rod is actuated to move towards the first position, and hydraulic fluid being received by the second hydraulic port and hydraulic fluid being discharged by the first hydraulic port when the trim rod is actuated to move towards the second position; and a bore connecting the trim cylinder to a down gallery, the bore allowing hydraulic fluid within the trim cylinder to recirculate to the reservoir when the trim rod is fully extended outside the trim cylinder.

5. A tilt cylinder unit which forms part of a trim and tilt system, the tilt cylinder unit comprising:

a tilt cylinder;

a piston disposed within the tilt cylinder;

a tilt rod connected to the piston, the tilt rod being reciprocatingly received within the tilt cylinder, and the tilt rod being movable between a first position in which the tilt rod is substantially disposed within the tilt cylinder and a second position in which the tilt rod is fully extended outside the tilt cylinder;

a first hydraulic port and a second hydraulic port hydraulically connecting the tilt cylinder unit to a reservoir, hydraulic fluid being received by the first hydraulic port and hydraulic fluid being discharged by the second hydraulic port when the tilt rod is actuated to move towards the first position, and hydraulic fluid being received by the second hydraulic port and hydraulic fluid being discharged by the first hydraulic port when the tilt rod is actuated to move towards the second position; and a bore connecting the tilt cylinder to a down gallery, the bore allowing hydraulic fluid within the tilt cylinder to recirculate to the reservoir when the tilt rod is fully extended outside the tilt cylinder.

* * * * *